US006189747B1

(12) United States Patent
Collingham et al.

(10) Patent No.: US 6,189,747 B1
(45) Date of Patent: Feb. 20, 2001

(54) HAND SEWING NEEDLE

(76) Inventors: James C. Collingham; Teresa A. Collingham, both of 62 Alden Ave., Yonkers, NY (US) 10710

( * ) Notice: Under 35 U.S.C. 154(b), the term of this patent shall be extended for 0 days.

(21) Appl. No.: 09/481,884

(22) Filed: Jan. 12, 2000

(51) Int. Cl.[7] ..... D05B 85/00
(52) U.S. Cl. ..... 223/102
(58) Field of Search ..... 223/102; 606/222, 606/223

(56) References Cited

U.S. PATENT DOCUMENTS 162,521 * 4/1875 Benton ..... 223/102
183,173 * 10/1876 Jenkins ..... 223/102
386,723 * 7/1888 Smith ..... 223/102
3,197,997 * 8/1965 Kurtz ..... 223/102
5,693,071 * 12/1997 Gorecki et al. ..... 606/222
6,006,965 * 12/1999 Hamman ..... 223/102

* cited by examiner

*Primary Examiner*—Bibhu Mohanty
(74) *Attorney, Agent, or Firm*—Michael S. Neustel

(57) ABSTRACT

A hand sewing needle for eliminating the requirement of turning the hand sewing needle after each pass through a piece of fabric. The inventive device includes an elongate body having a first end and a second end. An eyelet is positioned within the elongate body for receiving a length of thread, wherein the eyelet separates the elongate body into a first portion and a second portion. The first end and the second end of the elongate body may be comprised of any well-known structure such as pointed or blunt. The elongate body is preferably positioned at a center point of the elongate body.

15 Claims, 6 Drawing Sheets

HAND SEWING NEEDLE

BACKGROUND OF THE INVENTION

1. Field of the Invention

The present invention relates generally to hand sewing needles and more specifically it relates to a hand sewing needle for eliminating the requirement of turning the hand sewing needle after each pass through a piece of fabric.

2. Description of the Prior Art

Sewing needles have been in use for years. Typically, a conventional hand sewing needle has a body with a pointed end and an eyelet attached to the body opposite of the pointed end. The user attaches a length of thread within the eyelet and then grasps the body near the eyelet. The user inserts the thread the pointed end of the conventional hand-sewing needle through the fabric until the eyelet is drawn through the opposite side of the fabric. The user must then rotate the conventional needle 180 degrees so that the pointed end faces the opposite side of the fabric thereby allowing the user the manually insert the conventional needle from the opposite side of the fabric.

The main problem with conventional hand sewing needles is that they require the user to rotate the conventional hand sewing needle 180 degrees each time it is inserted through the fabric to sew a stitch. This increases the time required to complete a sewing job. Rotating the conventional hand sewing needle also requires the user to position their hands in awkward positions that can eventually cause injuries to the user's hands and wrists.

While these devices may be suitable for the particular purpose to which they address, they are not as suitable for eliminating the requirement of turning the hand sewing needle after each pass through a piece of fabric. Conventional hand sewing needles require the user to rotate the body of the needle 180 degrees after each insertion of the conventional needle.

In these respects, the hand sewing needle according to the present invention substantially departs from the conventional concepts and designs of the prior art, and in so doing provides an apparatus primarily developed for the purpose of eliminating the requirement of turning the hand sewing needle after each pass through a piece of fabric.

SUMMARY OF THE INVENTION

In view of the foregoing disadvantages inherent in the known types of hand sewing needles now present in the prior art, the present invention provides a new hand sewing needle construction wherein the same can be utilized for eliminating the requirement of turning the hand sewing needle after each pass through a piece of fabric.

The general purpose of the present invention, which will be described subsequently in greater detail, is to provide a new hand sewing needle that has many of the advantages of the hand sewing needles mentioned heretofore and many novel features that result in a new hand sewing needle which is not anticipated, rendered obvious, suggested, or even implied by any of the prior art hand sewing needles, either alone or in any combination thereof.

To attain this, the present invention generally comprises an elongate body having a first end and a second end. An eyelet is positioned within the elongate body for receiving a length of thread, wherein the eyelet separates the elongate body into a first portion and a second portion. The first end and the second end of the elongate body may be comprised of any well-known structure such as pointed or blunt. The elongate body is preferably positioned at a center point of the elongate body.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hand sewing needle that will overcome the shortcomings of the prior art devices.

A second object is to provide a hand sewing needle for eliminating the requirement of turning the hand sewing needle after each pass through a piece of fabric.

Another object is to provide a hand sewing needle that decreases the amount of time required to perform stitching upon a piece of fabric.

An additional object is to provide a hand sewing needle that is an improvement upon conventional hand sewing needles.

A further object is to provide a hand sewing needle that does not require rotating the needle 180 degrees after each stitch.

Another object is to provide a hand sewing needle that has the ability to do stitching using a single stroke while achieving dual results.

An additional object is to provide a hand sewing needle that allows individuals with physical disabilities, such as carpal tunnel syndrome, to stitch without pain and undue hardship.

A further object is to provide a hand sewing needle that reduces the strain upon hands, wrists and fingers.

A further object is to provide a hand sewing needle to assist individuals that cross stitch and needle point.

Another object is to provide a hand sewing needle that can have blunt ends or sharp points.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
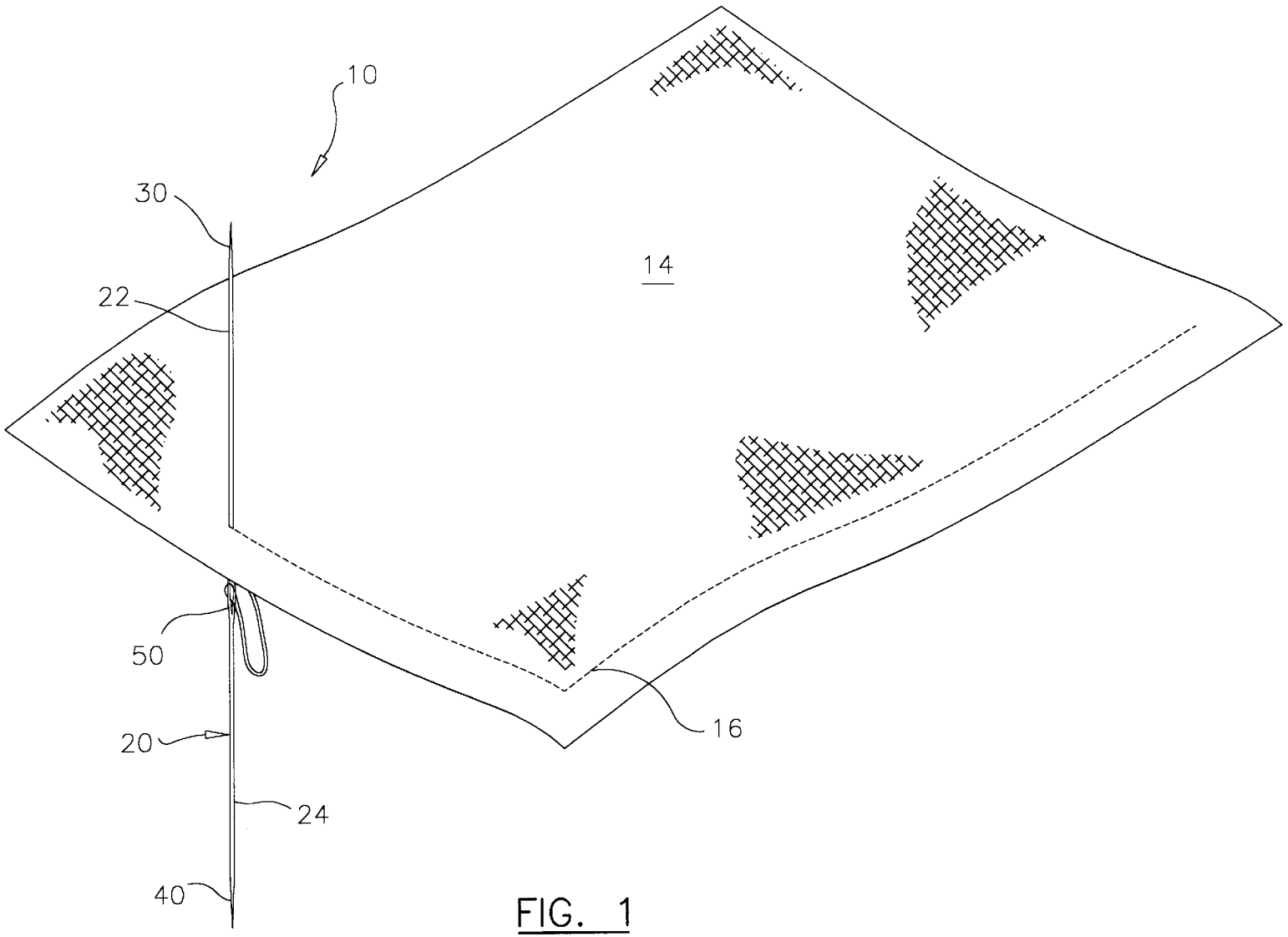
FIG. 1 is an upper perspective view of the present invention inserted into a piece of fabric.

Turning now descriptively to the drawings, in which similar reference characters denote similar elements throughout the several views, FIGS. 1 through 9 illustrate a hand sewing needle 10, which comprises an elongate body 20 having a first end 30 and a second end 40. An eyelet 50 is positioned within the elongate body 20 for receiving a length of thread 12, wherein the eyelet 50 separates the elongate body 20 into a first portion 22 and a second portion 24. The first end 30 and the second end 40 of the elongate body 20 may be comprised of any well-known structure such as pointed or blunt. The elongate body 20 is preferably positioned at a center point of the elongate body 20.

Figure 5:
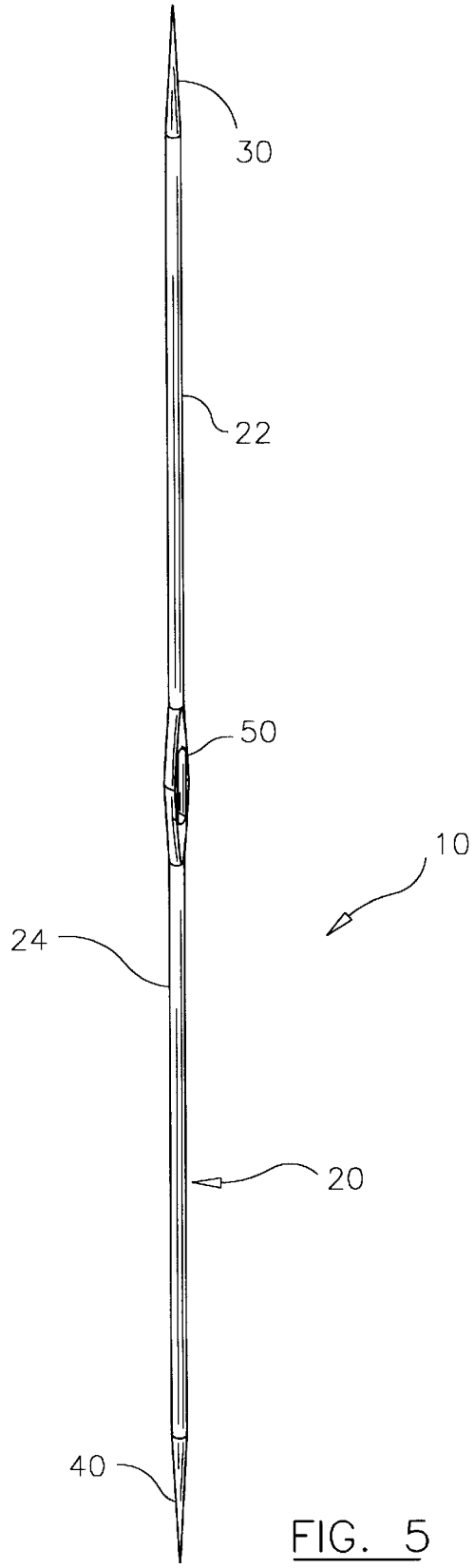
FIG. 5 is an upper perspective view of the present invention.
Figure 6:
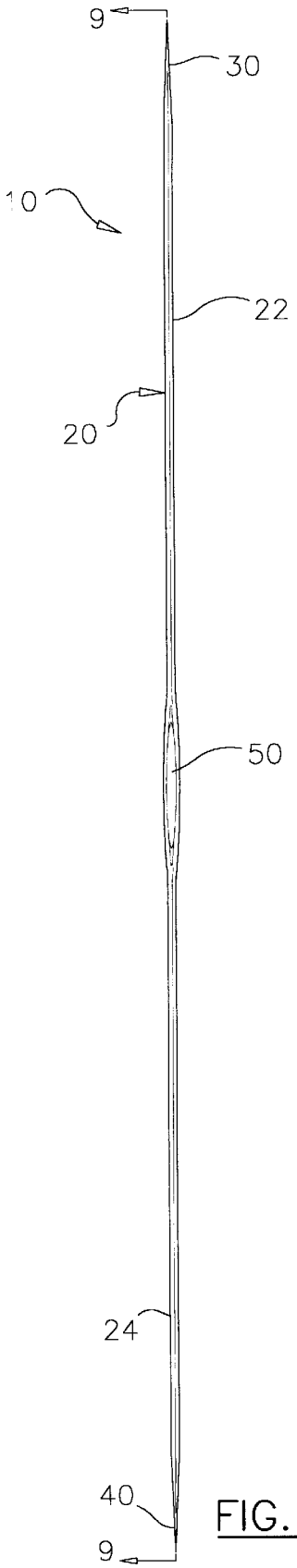
FIG. 6 is a front view of the present invention showing the opening within the eyelet.
Figure 7:
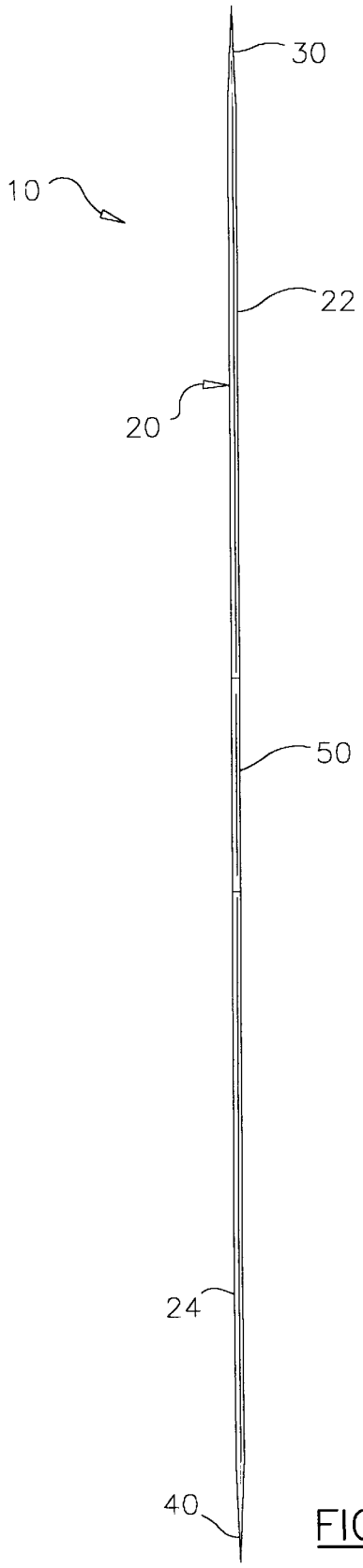
FIG. 7 is a side view of the present invention.
Figure 8:
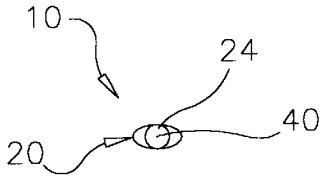
FIG. 8 is an end view of the present invention.

As best shown in FIGS. 5 through 7 of the drawings, the elongate body 20 is preferably cylindrical in shape. It can be appreciated by one skilled in the art that the elongate body 20 may have various cross sectional shapes such as circular, square, oval, rectangular and other well-known shapes. The elongate body 20 is preferably straight having a single axis and a center point. However, it can be appreciated that the elongate body 20 can have various other shapes including curved shapes.

The elongate body 20 may be solid in structure or may be comprised of a hollow structure. The elongate body 20 is preferably comprised of a metal such as carbon steel that may be copper-plated and nickel-plated. It can be appreciated that the elongate body 20 may be comprised of any common material such as metal or plastic.

As shown in FIGS. 1 through 7 and 9 of the drawings, the elongate body 20 includes a first end 30 and a second end 40. The first end 30 is opposite of the second end 40 upon the elongate body 20 as best shown in FIGS. 6 and 7 of the drawings. The ends 30, 40 are preferably tapered from the mid-section of the elongate body 20 forming a pointed end or a blunt end depending upon the use desired from the invention. It can be appreciated that the ends 30, 40 may have various other shapes and designs commonly utilized within the sewing industry which are hereby incorporated by reference.

Figure 2:
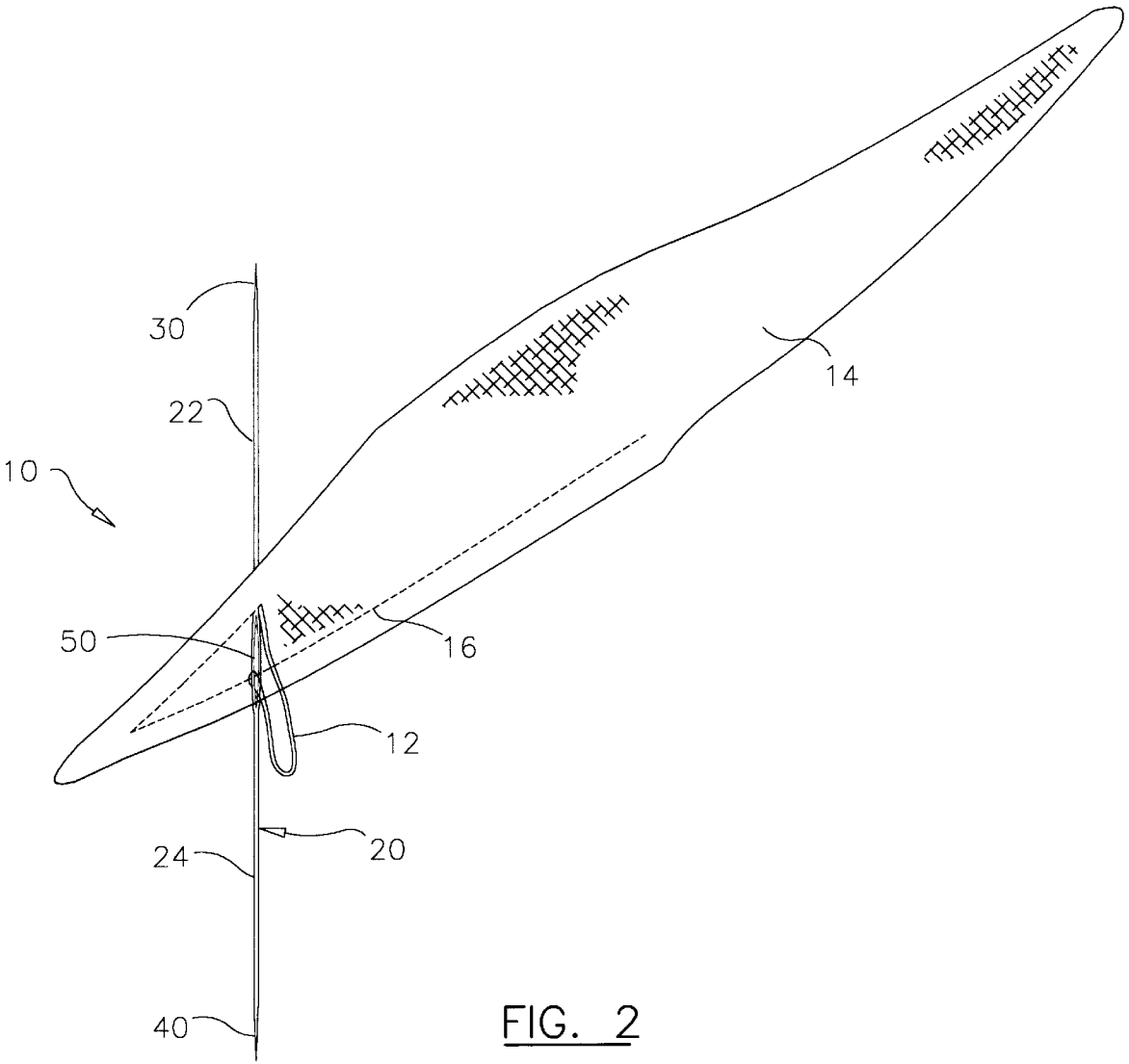
FIG. 2 is a lower perspective view of the present invention inserted into a piece of fabric.
Figure 4:
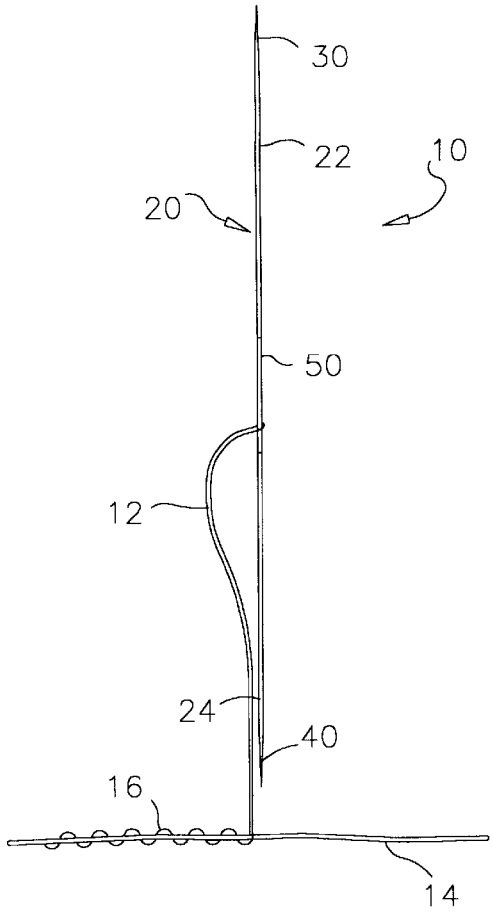
FIG. 4 is a side view of the present invention directly above a piece of fabric.
Figure 3:
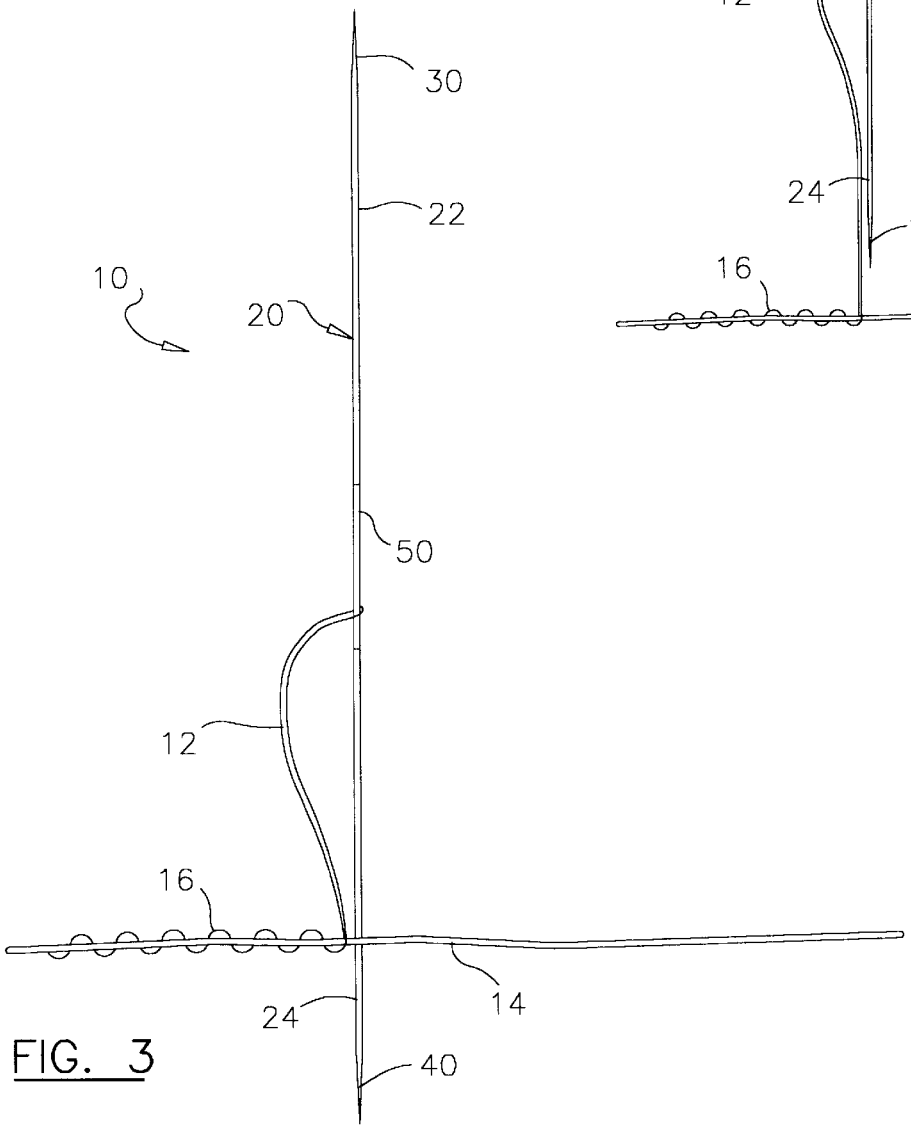
FIG. 3 is a side view of the present invention inserted into a piece of fabric.

As best shown in FIGS. 5 and 6 of the drawings, an eyelet 50 is positioned within the elongate body 20. The eyelet 50 is preferably symmetrical, however it is not required for proper operation of the invention. The eyelet 50 has an opening large enough to receive a portion of the length of thread 12 as shown in FIGS. 2 through 4 of the drawings. The opening within the eyelet 50 may have any well-known design such as oval, circular, square, rectangular or any other well-known shape. As shown in FIG. 6 of the drawings, the outside portions of the eyelet 50 are preferably curved and tapered toward the respective ends 30, 40 for allowing easy insertion through fabric 14 without catching upon the fabric 14. The eyelet 50 may extend outside the outer surface of the elongate body 20 or the eyelet 50 may have the same or less size as the outer surface of the elongate body 20.

Figure 9:
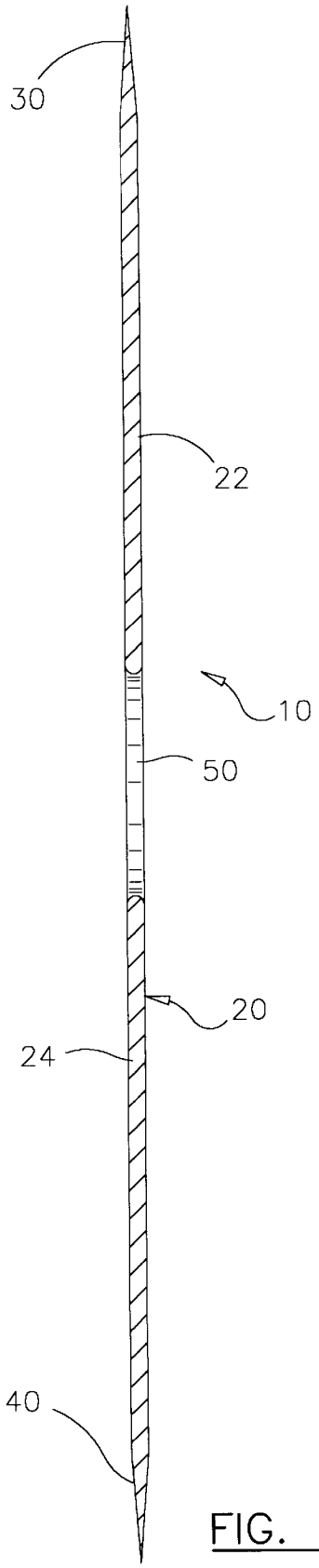
FIG. 9 is a cross sectional view taken along line 9—9 of FIG. 6.

As best shown in FIGS. 6 and 9 of the drawings, the eyelet 50 is preferably positioned about the center point of the elongate body 20 for providing consistency regardless of the portion of the invention being inserted into the fabric 14. However, it can be appreciated that the eyelet 50 may be positioned between the center point and the first end 30. The eyelet 50 may also be positioned between the center point and the second end 40. For most applications the eyelet 50 will be positioned within about the center point of the elongate body 20.

The eyelet 50 separates the elongate body 20 into a first portion 22 and a second portion 24 adjacent to the first end 30 and the second end 40 respectively as best shown in FIGS. 5 through 7 of the drawings. The first portion 22 is preferably approximately the same length as the second portion 24, however it can be appreciated that the portions 22, 24 may have differing lengths according to the position of the eyelet 50 within the elongate body 20.

In use, the user attaches a length of thread 12 within the eyelet 50 of the elongate body 20 and ties a knot to the opposing end of the length of thread 12. The user then positions the first end 30 of the elongate body 20 in opposition to a first side of a piece of fabric 14 desired to be sewn. The user then manually extends the first end 30 of the elongate body 20 along with the first portion 22 through the first side of the fabric 14. The user continues to manually insert the invention so that the eyelet 50 and eventually the second portion 24 pass through the fabric 14 at the entry point of the first end 30. The user then grasps the invention on the opposing second side of the fabric 14 and pulls the elongate body 20 entirely through the fabric 14 so that the second end 40 is pointing toward the second side of the fabric 14. The user then, without rotating the elongate body 20, inserts the second end 40 of the elongate body 20 into the second side of the fabric 14 along with the second portion 24. The user continues to force the elongate body 20 through the second side of the fabric 14 until the eyelet 50 and the first portion 22 have passed through exposing the first end 30 in opposition to the first side of the fabric 14. The above process is repeated until the desired number of stitches 16 have been created within the piece of fabric 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equilvalents may be resorted to, falling within the scope of the invention.

We claim:

1. A hand sewing needle, comprising:

an elongate body having a first end and a second end, wherein said elongate body is straight having a single axis extending between said first end and said second end and wherein said elongate body is a solid structure and wherein said first end and said second end each are comprised of a pointed shape; and an eyelet positioned within said elongate body between said first end and said second end.

2. The hand sewing needle of claim 1, wherein said eyelet is positioned at a center point of said elongate body.

3. The hand sewing needle of claim 2, wherein said eyelet is oval shaped.

4. The hand sewing needle of claim 1, wherein said eyelet is positioned adjacent a center point of said elongate body.

5. The hand sewing needle of claim 4, wherein said eyelet is oval shaped.

6. The hand sewing needle of claim 1, wherein said eyelet is positioned between a center point of said elongate body and said first end.

7. The hand sewing needle of claim 1, wherein said elongate body and said eyelet are symmetrical.

8. The hand sewing needle of claim 1, wherein said first end and said second end are tapered.

9. A hand sewing needle, comprising:

an elongate body having a first end, a second end and a center point, wherein said elongate body is straight having a single axis extending between said first end and said second end and wherein said elongate body is a solid structure and wherein said first end and said second end each are comprised of a pointed shape;

an eyelet positioned about said center point of said elongate body, wherein an outer perimeter of said eyelet has a width larger than a width of said elongate body; and wherein said elongate body is symmetrical.

10. The hand sewing needle of claim 9, wherein said eyelet is oval shaped.

11. The hand sewing needle of claim 9, wherein said elongate body is cylindrical in shape.

12. The hand sewing needle of claim 11, wherein said elongate body has a circular cross sectional area.

13. The hand sewing needle of claim 9, wherein said elongate body is comprised of carbon steel.

14. The hand sewing needle of claim 13, wherein said elongate body is copper plated.

15. The hand sewing needle of claim 13, wherein said elongate body is nickel plated.

* * * * *